US008641833B2

(12) United States Patent
Niinae et al.

(10) Patent No.: US 8,641,833 B2
(45) Date of Patent: Feb. 4, 2014

(54) CORROSION-RESISTANT MAGNET AND METHOD FOR PRODUCING THE SAME

(75) Inventors: Toshinobu Niinae, Saitama (JP); Koshi Yoshimura, Osaka (JP); Koji Kamiyama, Hyogo (JP)

(73) Assignee: Hitachi Metals, Ltd., Tokyo (JP)

( * ) Notice: Subject to any disclaimer, the term of this patent is extended or adjusted under 35 U.S.C. 154(b) by 313 days.

(21) Appl. No.: 13/002,571

(22) PCT Filed: Jun. 30, 2009

(86) PCT No.: PCT/JP2009/061913

§ 371 (c)(1),
(2), (4) Date: Mar. 30, 2011

(87) PCT Pub. No.: WO2010/001878

PCT Pub. Date: Jan. 7, 2010

(65) Prior Publication Data

US 2011/0186181 A1 Aug. 4, 2011

(30) Foreign Application Priority Data

Jul. 4, 2008 (JP) ..... 2008-176029
Jul. 4, 2008 (JP) ..... 2008-176033

(51) Int. Cl.
*C23C 22/48* (2006.01)
*H01F 1/053* (2006.01)
*H01F 7/00* (2006.01)

(52) U.S. Cl.
USPC ..... 148/247; 428/611; 335/302; 148/101; 427/127

(58) Field of Classification Search
USPC ..... 148/101, 247; 335/302; 427/127; 428/611
See application file for complete search history.

(56) References Cited

U.S. PATENT DOCUMENTS

| | | | | |
|---|---|---|---|---|
| 6,281,774 | B1 * | 8/2001 | Nishiuchi et al. | 335/302 |
| 2002/0036029 | A1 * | 3/2002 | Kikugawa et al. | 148/101 |
| 2007/0071979 | A1 * | 3/2007 | Komuro et al. | 428/403 |

FOREIGN PATENT DOCUMENTS

| | | | |
|---|---|---|---|
| JP | 04-042517 | A | 2/1992 |
| JP | 2000-199074 | | 7/2000 |
| JP | 2004-221196 | A1 | 8/2004 |
| JP | 2008/270699 | A1 | 11/2008 |
| JP | 2002-198241 | A | 7/2012 |
| WO | WO 02/103080 | A1 | 12/2002 |

OTHER PUBLICATIONS

International Search Report for International Application No. PCT/JP2009/061913 dated Dec. 1, 2009.
Office Action issued Sep. 3, 2013 corresponding to Japanese patent application No. 2010-128628.

* cited by examiner

*Primary Examiner* — Lois Zheng
(74) *Attorney, Agent, or Firm* — Kratz, Quintos & Hanson, LLP

(57) ABSTRACT

An object of the present invention is to provide an R—Fe—B based sintered magnet having on a surface thereof a chemical conversion film with higher corrosion resistance than a conventional chemical conversion film such as a phosphate film, and a method for producing the same. The corrosion-resistant magnet of the present invention as a means for achieving the object is characterized by comprising a chemical conversion film containing at least Zr, Nd, fluorine, and oxygen as constituent elements and not containing phosphorus directly on a surface of an R—Fe—B based sintered magnet, wherein R is a rare-earth element including at least Nd.

12 Claims, 2 Drawing Sheets

CORROSION-RESISTANT MAGNET AND METHOD FOR PRODUCING THE SAME

TECHNICAL FIELD

The present invention relates to an R—Fe—B based sintered magnet with corrosion resistance and also to a method for producing the same.

BACKGROUND ART

Nowadays, R—Fe—B based sintered magnets represented by Nd—Fe—B based sintered magnets have been used in various fields for their high magnetic characteristics. However, an R—Fe—B based sintered magnet contains a highly reactive rare-earth metal: R, and thus is susceptible to oxidization and corrosion in air. Therefore, when such a magnet is used without a surface treatment, corrosion proceeds from the surface due to the presence of small amounts of acids, alkalis, water, etc., whereby rust occurs, causing deterioration or fluctuation in the magnetic characteristics. Further, when such a rusted magnet is incorporated into a device such as a magnetic circuit, the rust may be dispersed and contaminate peripheral parts.

Various methods are known for imparting corrosion resistance to an R—Fe—B based sintered magnet. One of them is a method in which a surface of the magnet is subjected to chemical conversion treatment to form a chemical conversion film. For example, Patent Document 1 describes a method in which a phosphate film is formed as a chemical conversion film on the magnet surface. This method has been widely employed as a simple rust-prevention method for easily imparting necessary corrosion resistance to a magnet.

Patent Document 1: JP-B-4-22008

DISCLOSURE OF THE INVENTION

Problems that the Invention is to Solve

However, a method as described in Patent Document 1, in which a chemical conversion film is directly formed on the surface of an R—Fe—B based sintered magnet, does not go beyond conventional, simple rust-prevention methods, and is likely to cause the shedding of magnetic particles or the formation of cracks in the magnet in an environment that promotes corrosion. Accordingly, there has been a demand for the development of a method for forming a chemical conversion film with improved corrosion resistance.

Thus, the present invention is aimed to provide an R—Fe—B based sintered magnet having on a surface thereof a chemical conversion film with higher corrosion resistance than a conventional chemical conversion film such as a phosphate film, and more specifically a chemical conversion film capable of preventing the shedding of magnetic particles or the formation of cracks in the magnet even when subjected to a corrosion resistance test, such as a pressure cooker test, under the conditions of temperature: 125° C., relative humidity: 85%, and pressure: 2 atm or the conditions of temperature: 120° C., relative humidity: 100%, and pressure: 2 atm, for example. The present invention is also aimed to provide a method for producing the same.

Means for Solving the Problems

A corrosion-resistant magnet of the present invention accomplished in light of the above points is, as defined in claim 1, characterized by comprising a chemical conversion film containing at least Zr, Nd, fluorine, and oxygen as constituent elements and not containing phosphorus directly on a surface of an R—Fe—B based sintered magnet, wherein R is a rare-earth element including at least Nd.

A corrosion-resistant magnet as defined in claim 2 is characterized in that in the corrosion-resistant magnet according to claim 1, the chemical conversion film further contains Fe as a constituent element.

A corrosion-resistant magnet as defined in claim 3 is characterized in that in the corrosion-resistant magnet according to claim 2, the chemical conversion film has a thickness of 10 nm to 150 nm.

A corrosion-resistant magnet as defined in claim 4 is characterized in that in the corrosion-resistant magnet according to claim 2, a comparison between a region of an outer-surface-side half of the thickness of the chemical conversion film and a region of a magnet-side half of the thickness of the chemical conversion film shows that the former has a higher Zr content than the latter.

A corrosion-resistant magnet as defined in claim 5 is characterized in that in the corrosion-resistant magnet according to claim 4, the region of the outer-surface-side half has a maximum Zr content of 5 at % to 30 at % in the thickness direction thereof.

A corrosion-resistant magnet as defined in claim 6 is characterized in that in the corrosion-resistant magnet according to claim 2, the chemical conversion film has higher Nd and fluorine contents above a grain boundary phase of the surface of the magnet than above a main phase of the surface of the magnet.

A corrosion-resistant magnet as defined in claim 7 is characterized in that in the corrosion-resistant magnet according to claim 6, the chemical conversion film has a maximum fluorine content of 1 at % to 5 at % in the thickness direction thereof above the grain boundary phase of the surface of the magnet.

A corrosion-resistant magnet as defined in claim 8 is characterized in that the corrosion-resistant magnet according to claim 2 comprises a resin film on a surface of the chemical conversion film.

A corrosion-resistant magnet as defined in claim 9 is characterized in that in the corrosion-resistant magnet according to claim 1, the surface of the magnet has a layer made of a compound containing Nd and oxygen.

A corrosion-resistant magnet as defined in claim 10 is characterized in that in the corrosion-resistant magnet according to claim 9, the chemical conversion film has a thickness of 10 nm to 150 nm.

A corrosion-resistant magnet as defined in claim 11 is characterized in that in the corrosion-resistant magnet according to claim 9, the chemical conversion film has a maximum Zr content of 10 at % to 20 at % in the thickness direction thereof.

A corrosion-resistant magnet as defined in claim 12 is characterized in that the corrosion-resistant magnet according to claim 9 comprises a resin film on a surface of the chemical conversion film.

A method for producing a corrosion-resistant magnet of the present invention is, as defined in claim 13, characterized in that a chemical conversion film containing at least Zr, Nd, Fe, fluorine, and oxygen as constituent elements and not containing phosphorus is formed on a surface of an R—Fe—B based sintered magnet, wherein R is a rare-earth element including at least Nd.

A method for producing a corrosion-resistant magnet of the present invention is, as defined in claim 14, characterized in that an R—Fe—B based sintered magnet, wherein R is a rare-earth element including at least Nd, is subjected to a heat treatment at a temperature range of 450° C. to 900° C., and then a chemical conversion film containing at least Zr, Nd, fluorine, and oxygen as constituent elements and not containing phosphorus is formed on a surface thereof.

A production method as defined in claim 15 is characterized in that in the production method according to claim 14, the heat treatment is performed with the magnet being housed in a heat-resistant box.

Effect of the Invention

The present invention enables the provision of an R—Fe—B based sintered magnet having on a surface thereof a chemical conversion film with higher corrosion resistance than a conventional chemical conversion film such as a phosphate film, and a method for producing the same.

BEST MODE FOR CARRYING OUT THE INVENTION

Figure 1:
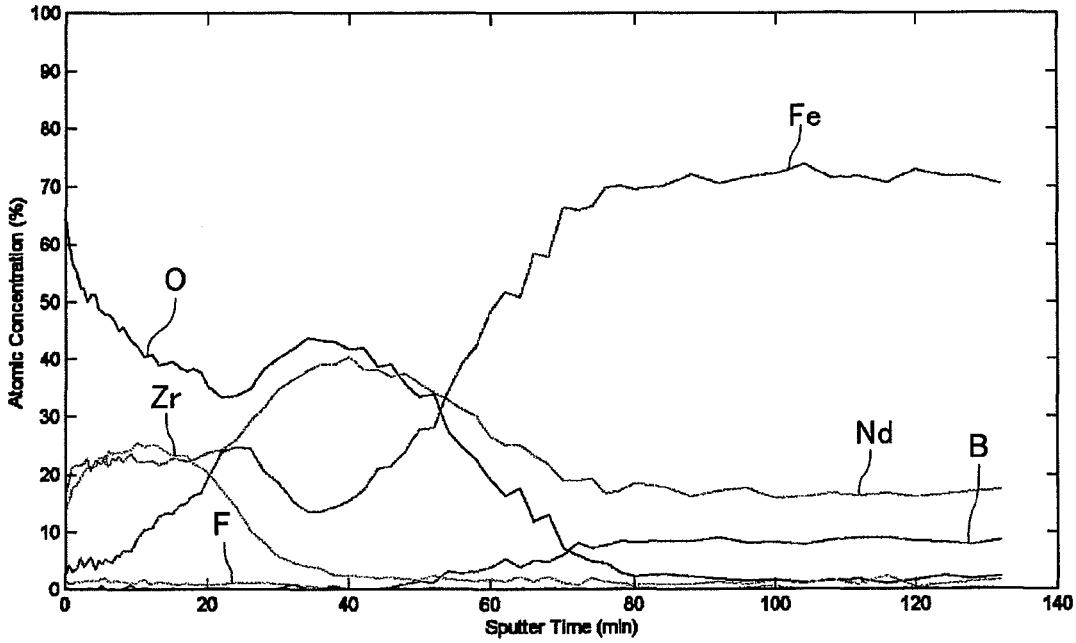
FIG. 1 A chart showing results of an Auger spectroscopy depth profile analysis of a chemical conversion film above the main phase in Example 1.

A corrosion-resistant magnet of the present invention is characterized by comprising a chemical conversion film containing at least Zr, Nd, fluorine, and oxygen as constituent elements and not containing phosphorus directly (in other words, "with no intermediate film") on a surface of an R—Fe—B based sintered magnet, wherein R is a rare-earth element including at least Nd. Hereinafter, the R—Fe—B based sintered magnet, wherein R is a rare-earth element including at least Nd, is sometimes referred to simply as "R—Fe—B based sintered magnet" or "magnet".

The R—Fe—B based sintered magnet to be treated in the present invention, wherein R is a rare-earth element including at least Nd, may be a product at the stage where it has undergone a surface working, such as cutting or grinding, and thus has been adjusted to a predetermined size, for example. Corrosion-resistant magnets according to the present invention are roughly classified into corrosion-resistant magnets obtained, without any special artificial pre-processing on the magnet to be treated, by forming a predetermined chemical conversion film on the surface thereof (first embodiment) and corrosion-resistant magnets obtained by subjecting the magnet to be treated to a predetermined heat treatment and then forming a predetermined chemical conversion film on the surface thereof (second embodiment). Hereinafter, the details of a corrosion-resistant magnet of each embodiment will be described.

First Embodiment

Corrosion-resistant magnet obtained, without any special artificial pre-processing on the magnet to be treated, by forming a predetermined chemical conversion film on the surface thereof The chemical conversion film of the corrosion-resistant magnet of the first embodiment contains at least Fe in addition to Zr, Nd, fluorine, and oxygen as constituent elements (Nd and Fe are elements from the constituents of the magnet). An example of a method for forming a chemical conversion film containing at least Zr, Nd, Fe, fluorine, and oxygen as constituent elements and not containing phosphorus on a surface of an R—Fe—B based sintered magnet, wherein R is a rare-earth element including at least Nd, is a method in which an aqueous solution containing at least Zr and fluorine is applied as a treatment liquid to the surface of the magnet, followed by drying. A specific example of the treatment liquid is a solution prepared by dissolving a compound containing Zr and fluorine, such as fluorozirconic acid ($H_2ZrF_6$), or an alkali metal salt, an alkaline earth metal salt or an ammonium salt of fluorozirconic acid, in water (hydrofluoric acid or the like may be further added). The Zr content of the treatment liquid is preferably 1 ppm to 2000 ppm as metal, and more preferably 10 ppm to 1000 ppm. This is because when the content is less than 1 ppm, a chemical conversion film may not be formed, while a content of more than 2000 ppm may increase the cost. The fluorine content of the treatment liquid is preferably 10 ppm to 10000 ppm as fluorine concentration, and more preferably 50 ppm to 5000 ppm. This is because when the content is less than 10 ppm, the surface of the magnet may not be efficiently etched, while a content of more than 10000 ppm may result in an etching rate higher than the rate of film formation, making it difficult to form a uniform film. The treatment liquid may also be prepared by dissolving a fluorine-free Zr compound, such as zirconium tetrachloride, or a sulfate or nitrate of Zr, and a Zr-free fluorine compound, such as hydrofluoric acid, ammonium fluoride, ammonium hydrogen fluoride, sodium fluoride, or sodium hydrogen fluoride, in water. The treatment liquid may have sources of Nd and Fe, constituent elements of the chemical conversion film, or may have no such sources. This is because as the surface of the R—Fe—B based sintered magnet, wherein R is a rare-earth element including at least Nd, is etched in the course of chemical conversion treatment, these elements are eluted from the magnet and incorporated into the chemical conversion film. The pH of the treatment liquid is preferably adjusted to 1 to 6. This is because when the pH is less than 1, the surface of the magnet may be excessively etched, while a pH of more than 6 may affect the stability of the treatment liquid.

For the purpose of improving the reactivity in the chemical conversion treatment, improving the stability of the treatment liquid, improving the adherence between the chemical conversion film and the surface of the magnet, improving the adhesiveness with an adhesive used for the incorporation of the magnet into a part, etc., the treatment liquid may also contain, in addition to the above components, organic acids such as tannic acid, oxidizing agents (hydrogen peroxide, chloric acid and salts thereof, nitrous acid and salts thereof, nitric acid and salts thereof, tungstic acid and salts thereof, molybdenum acid and salts thereof, etc.), water-soluble resins such as water-soluble polyamide and polyallylamine, etc.

In the case where the treatment liquid itself lacks storage stability, such a treatment liquid may be prepared when needed. An example of a commercially available treatment liquid usable in the present invention is PALLUCID 1000 (trade name) prepared from PALLUCID 1000MA and AD-4990 manufactured by NIHON PARKERIZING CO., LTD.

As a method for applying the treatment liquid to the surface of the R—Fe—B based sintered magnet, immersion, spraying, spin coating, or the like can be employed. Upon application, the temperature of the treatment liquid is preferably 20° C. to 80° C. This is because when the temperature is less than 20° C., the reaction may not proceed, while a temperature of more than 80° C. may affect the stability of the treatment liquid. The treatment time is usually 10 seconds to 10 minutes.

After the treatment liquid is applied to the surface of the magnet, a drying treatment is performed. When the temperature of the drying treatment is less than 50° C., sufficient drying cannot be achieved, and this may degrade the appearance or affect the adhesiveness with an adhesive used for the incorporation of the magnet into a part. When the temperature is more than 250° C., this may cause decomposition of the formed chemical conversion film. Therefore, the temperature is preferably 50° C. to 250° C. From the viewpoint of productivity and production cost, a temperature of 50° C. to 200° C. is more preferable. The drying treatment time is usually 5 seconds to 1 hour.

The chemical conversion film formed by the above method, which contains at least Zr, Nd, Fe, fluorine, and oxygen as constituent elements and does not contain phosphorus, is firmly in close contact with the surface of the R—Fe—B based sintered magnet, and thus exhibits sufficient corrosion resistance when the thickness thereof is 10 nm or more. The upper limit of the thickness of the chemical conversion film is not limited. However, for demands based on the miniaturization of a magnet itself and also from the viewpoint of production cost, the thickness is preferably 150 nm or less, and more preferably 100 nm or less. The chemical conversion film formed on the surface of the magnet is characterized in that a comparison between a region of the outer-surface-side half of its thickness and a region of the magnet-side half of its thickness shows that the former has a higher Zr content than the latter. Therefore, the region of the outer-surface-side half contains a large amount of Zr-containing compound. The Zr-containing compound may be Zr oxide with excellent corrosion resistance, for example, and it is presumed that the presence of Zr oxide contributes to the corrosion resistance of the chemical conversion film. The region of the outer-surface-side half has a maximum Zr content of 5 at % to 30 at % in the thickness direction thereof. Also, the chemical conversion film formed on the surface of the magnet is characterized by having higher Nd and fluorine contents above a grain boundary phase (R-rich phase) of the magnet surface than above a main phase ($R_2Fe_{14}B$ phase) of the magnet surface. Therefore, it is expected that the chemical conversion film above the grain boundary phase contains a large amount of Nd fluoride produced by a reaction of fluorine in the treatment liquid with Nd contained in the grain boundary phase. Nd fluoride is chemically extremely stable. Therefore, it is presumed that one reason for the excellent corrosion resistance of the chemical conversion film is that the thus-produced Nd fluoride is present to cover the grain boundary phase, thereby contributing to preventing the shedding of magnetic particles or the formation of cracks in the magnet. The chemical conversion film has a maximum fluorine content of 1 at % to 5 at % in the thickness direction thereof above the grain boundary phase of the magnet surface.

Second Embodiment

Corrosion-resistant magnet obtained by subjecting the magnet to be treated to a heat treatment and then forming a predetermined chemical conversion film on the surface thereof.

The chemical conversion film of the corrosion-resistant magnet of the second embodiment contains at least Zr, Nd, fluorine, and oxygen as constituent elements (Nd is an element from the constituents of the magnet). Unlike the chemical conversion film of the corrosion-resistant magnet of the first embodiment, the chemical conversion film in the second embodiment contains little Fe (the maximum Fe content in the thickness direction is only about 3 at %). A corrosion resistance test, such as a pressure cooker test, on an R—Fe—B-based sintered magnet having on the surface thereof a conventional chemical conversion film such as a phosphate film is accompanied by the shedding of magnetic particles or the formation of cracks in the magnet; the starting point of the development of this corrosion-resistant magnet lies in the assumption that the insufficient corrosion resistance immediately above a grain boundary phase of the magnet surface might be one cause thereof. The surface of an R—Fe—B based sintered magnet is not uniform, and mainly includes a main phase ($R_2Fe_{14}B$ phase) and a grain boundary phase (R-rich phase). It is known that the main phase has relatively stable corrosion resistance, whereas the grain boundary phase has lower corrosion resistance as compared with the main phase. It was thus speculated that one cause of the shedding of magnetic particles or the formation of cracks in the magnet after a corrosion resistance test might be that the elution of R of the grain boundary phase from the magnet surface cannot be effectively prevented. Then, various studies were made based on a consideration that if the surface of an R—Fe—B based sintered magnet was made uniform first, and a chemical conversion film was then formed, adverse effects of the grain boundary phase of the magnet surface on corrosion resistance would be avoided. As a result, it was found that a heat treatment of a magnet at a predetermined temperature range makes the surface of the magnet uniform, and that by subsequently forming a chemical conversion film containing at least Zr, Nd, fluorine, and oxygen as constituent elements and not containing phosphorus, the magnet can be provided with excellent corrosion resistance.

The heat treatment of the magnet to be treated is preferably performed at a temperature range of 450° C. to 900° C., for example. When the heat treatment is performed at this temperature range, Nd of the grain boundary phase exudes from the magnet surface, and a layer made of a compound containing Nd and oxygen (e.g., Nd oxide), which is expected to be produced by a reaction of such Nd with oxygen gas present in the treatment atmosphere, is formed in the magnet surface as a heat-treatment layer. As a result, the entire surface can be efficiently made uniform. Usually, such a layer has an Nd content of 10 at % to 50 at % and an oxygen content of 5 at % to 70 at %. The layer preferably has a thickness of 100 nm to 500 nm. This is because when the layer is too thin, it may be difficult to avoid adverse effects of the grain boundary phase of the magnet surface on corrosion resistance, while when the layer is too thick, productivity may be reduced. In the heat treatment, when a large amount of oxygen gas is present in the treatment atmosphere, this may cause corrosion of the magnet. Therefore, it is preferable to perform the treatment in an atmosphere where an amount of oxygen gas is reduced, such as in a vacuum of about 1 Pa to about 10 Pa, in an atmosphere of an inert gas such as an argon gas, or in an atmosphere of a reducing gas reactive with oxygen such as a hydrogen gas. The treatment time is usually 5 minutes to 40 hours. According to an ordinary magnet production process, the magnet to be treated has been previously aged for imparting desired magnetic characteristics thereto. However, when the heat treatment in this embodiment is performed to also achieve the purpose of aging, the aging to be performed prior to the surface working for adjustment to a predetermined size can be omitted.

As a method for forming a chemical conversion film containing at least Zr, Nd, fluorine, and oxygen as constituent elements and not containing phosphorus on the surface of the above heat-treated magnet, for example, a method in which an aqueous solution containing at least Zr and fluorine is applied as a treatment liquid to the surface of the heat-treated magnet, followed by drying, can be mentioned. A specific example of the treatment liquid is a solution prepared by dissolving a compound containing Zr and fluorine, such as fluorozirconic acid ($H_2ZrF_6$), or an alkali metal salt, an alkaline earth metal salt or an ammonium salt of fluorozirconic acid, in water (hydrofluoric acid or the like may be further added). The Zr content of the treatment liquid is preferably 1 ppm to 2000 ppm as metal, and more preferably 10 ppm to 1000 ppm. This is because when the content is less than 1 ppm, a chemical conversion film may not be formed, while a content of more than 2000 ppm may increase the cost. The fluorine content of the treatment liquid is preferably 10 ppm to 10000 ppm as fluorine concentration, and more preferably 50 ppm to 5000 ppm. This is because when the content is less than 10 ppm, the surface of the magnet may not be efficiently etched, while a content of more than 10000 ppm may result in an etching rate higher than the rate of film formation, making it difficult to form a uniform film. The treatment liquid may also be prepared by dissolving a fluorine-free Zr compound, such as zirconium tetrachloride, or a sulfate or nitrate of Zr, and a Zr-free fluorine compound, such as hydrofluoric acid, ammonium fluoride, ammonium hydrogen fluoride, sodium fluoride, or sodium hydrogen fluoride, in water. The treatment liquid may have a source of Nd, a constituent element of the chemical conversion film, or may have no such source. This is because as the surface of the layer made of a compound containing Nd and oxygen formed in the magnet surface is etched in the course of chemical conversion treatment, Nd is eluted from the layer and incorporated into the chemical conversion film. The pH of the treatment liquid is preferably adjusted to 1 to 6. This is because when the pH is less than 1, the surface of the magnet may be excessively etched, while a pH of more than 6 may affect the stability of the treatment liquid.

For the purpose of improving the reactivity in the chemical conversion treatment, improving the stability of the treatment liquid, improving the adherence between the chemical conversion film and the surface of the heat-treated magnet, improving the adhesiveness with an adhesive used for the incorporation of the magnet into a part, etc., the treatment liquid may also contain, in addition to the above components, organic acids such as tannic acid, oxidizing agents (hydrogen peroxide, chloric acid and salts thereof, nitrous acid and salts thereof, nitric acid and salts thereof, tungstic acid and salts thereof, molybdenum acid and salts thereof, etc.), water-soluble resins such as water-soluble polyamide and polyallylamine, etc.

In the case where the treatment liquid itself lacks storage stability, such a treatment liquid may be prepared when needed. An example of a commercially available treatment liquid usable in the present invention is PALLUCID 1000 (trade name) prepared from PALLUCID 1000MA and AD-4990 manufactured by NIHON PARKERIZING CO., LTD.

As a method for applying the treatment liquid to the surface of the heat-treated magnet, immersion, spraying, spin coating, or the like can be employed. Upon application, the temperature of the treatment liquid is preferably 20° C. to 80° C. This is because when the temperature is less than 20° C., the reaction may not proceed, while a temperature of more than 80° C. may affect the stability of the treatment liquid. The treatment time is usually 10 seconds to 10 minutes.

After the treatment liquid is applied to the surface of the heat-treated magnet, a drying treatment is performed. When the temperature of the drying treatment is less than 50° C., sufficient drying cannot be achieved, and this may degrade the appearance or affect the adhesiveness with an adhesive used for the incorporation of the magnet into a part. When the temperature is more than 250° C., this may cause decomposition of the formed chemical conversion film. Therefore, the temperature is preferably 50° C. to 250° C. From the viewpoint of productivity and production cost, a temperature of 50° C. to 200° C. is more preferable. The drying treatment time is usually 5 seconds to 1 hour.

The chemical conversion film formed by the above method, which contains at least Zr, Nd, fluorine, and oxygen as constituent elements and does not contain phosphorus, is firmly in close contact with the surface of the layer made of a compound containing Nd and oxygen formed in the surface of the R—Fe—B based sintered magnet, and thus exhibits sufficient corrosion resistance when the thickness thereof is 10 nm or more. The upper limit of the thickness of the chemical conversion film is not limited. However, for demands based on the miniaturization of a magnet itself and also from the viewpoint of production cost, the thickness is preferably 150 nm or less, and more preferably 100 nm or less. The chemical conversion film is characterized in that a comparison between a region of the outer-surface-side half of its thickness and a region of the magnet-side half of its thickness shows that the former has a higher Zr content than the latter. Therefore, the region of the outer-surface-side half contains a large amount of Zr-containing compound. The Zr-containing compound may be Zr oxide with excellent corrosion resistance, for example, and it is presumed that the presence of Zr oxide contributes to the corrosion resistance of the chemical conversion film. The region of the outer-surface-side half has a maximum Zr content of 10 at % to 20 at % in the thickness direction thereof. Also, it is expected that the chemical conversion film contains Nd fluoride produced by a reaction of fluorine in the treatment liquid with Nd contained in the layer made of a compound containing Nd and oxygen formed in the magnet surface. Nd fluoride is chemically extremely stable. Therefore, it is presumed that the presence of the thus-produced Nd fluoride is one reason for the excellent corrosion resistance of the chemical conversion film. The chemical conversion film has a maximum fluorine content of 1 at % to 10 at % in the thickness direction thereof.

Significant advantages of the corrosion-resistant magnet of the second embodiment are as follows. A heat-treatment layer formed in the magnet surface by a heat treatment of the magnet (layer made of a compound containing Nd and oxygen) is provided with a uniform and adequate oxygen content; as a result, a chemical conversion film with excellent corrosion resistance can be formed on the surface thereof, and, in addition, the strength of adhesion with other materials after the formation of the chemical conversion film can be improved. Such effects are attributed to that a layer deteriorated by processing, which includes small cracks or distortion caused in the magnet surface by a surface working or the like, is repaired by the heat treatment, and also that a dense heat-treatment layer that withstands stress on the interface between the chemical conversion film and the magnet makes the entire magnet surface uniform. The oxygen content of the heat-treatment layer is preferably 8 at % to 50 at %, and more preferably 20 at % to 40 at %. When the oxygen content is less than 8 at %, a heat-treatment layer that sufficiently repairs the layer deteriorated by processing may not be formed, while when the oxygen content is more than 50 at %, the heat-treatment layer may be embrittled, whereby adhesion strength will not be improved (even when the oxygen content is less than 8 at % or more than 50 at %, such an oxygen content itself does not adversely affect the formation of a chemical conversion film with excellent corrosion resistance). An example of a simple method for providing the heat-treatment layer with a uniform and adequate oxygen content is a method in which the magnet to be treated is housed in a heat-resistant box made of a metal such as molybdenum (preferably a box that includes a case body with an open top and a lid, and is configured to allow outside air to pass between the case body and the lid), and then subjected to heat treatment. By using such a method, the magnet to be treated can be protected from the direct effects of a temperature increase in the heat treatment apparatus or variations in the atmosphere. As a result, a heat-treatment layer having a uniform and adequate oxygen content can be formed in the magnet surface.

The rare-earth element (R) in the R—Fe—B based sintered magnet used in the present invention includes at least Nd. The rare-earth element (R) may also include at least one of Pr, Dy, Ho, Tb, and Sm, and may further include at least one of La, Ce, Gd, Er, Eu, Tm, Yb, Lu, and Y. Although a single kind of R is usually sufficient, in practical application, a mixture of two or more kinds (misch metal, didym, etc.) may also be used for the reason of availability. With respect to the R content of the R—Fe—B based sintered magnet, when it is less than 10 at %, the crystal structure is a cubic crystal structure that is the same as α-Fe, and, therefore, high magnetic characteristics, particularly high magnetic coercive force (iHc), cannot be obtained. Meanwhile, when it is more than 30 at %, this results in an increased amount of R-rich non-magnetic phase, reducing the residual magnetic flux density (Br), whereby a permanent magnet with excellent characteristics cannot be obtained. Accordingly, the R content is preferably 10 at % to 30 at % of the composition.

With respect to the Fe content, when it is less than 65 at %, the Br decreases, while when it is more than 80 at %, high iHc cannot be obtained. Accordingly, the Fe content is preferably 65 at % to 80 at %. Further, by substituting a part of Fe with Co, the temperature characteristics of the resulting magnet can be improved without impairing its magnetic characteristics. However, when the Co substitution amount is more than 20 at % of Fe, the magnetic characteristics are degraded, and this thus is undesirable. A Co substitution amount of 5 at % to 15 at % leads to a higher Br than in the case where substitution is not performed, and this thus is desirable in order to obtain a high magnetic flux density.

With respect to the B content, when it is less than 2 at %, the resulting main phase has a rhombohedron structure, and high iHc cannot be obtained, while when it is more than 28 at %, this results in an increased amount of B-rich non-magnetic phase, whereby the Br decreases, and a permanent magnet with excellent characteristics cannot be obtained. Accordingly, the B content is preferably 2 at % to 28 at %. In order to improve the magnet productivity or reduce the price, the magnet may contain at least one of 2.0 wt % or less of P and 2.0 wt % or less of S in a total amount of 2.0 wt % or less. Further, a part of B may be substituted with C in an amount of 30 wt % or less so as to improve the corrosion resistance of the magnet.

Further, the addition of at least one of Al, Ti, V, Cr, Mn, Bi, Nb, Ta, Mo, W, Sb, Ge, Sn, Zr, Ni, Si, Zn, Hf, and Ga is effective in improving magnetic coercive force or the squareness of the demagnetization curve, improving productivity, and reducing the price. Regarding the amount to be added, because a Br of at least 9 kG is required in order to achieve an maximum energy product (BH) max of 20 MGOe or more, it is preferable to add an amount within a range that satisfies such conditions. In addition to R, Fe, and B, the R—Fe—B based sintered magnet may also contain impurities inevitable in the industrial production.

Of R—Fe—B based sintered magnets for use in the present invention, a magnet characterized by including a compound with a tetragonal-system crystal structure as the main phase, where the average crystal particle diameter is within a range of 1 μm to 80 μm, and having a non-magnetic phase (excluding the oxide phase) in a proportion of 1% to 50% by volume shows iHc≥1 kOe, Br>4 kG, and (BH)max≥10 MGOe, with the maximum (BH)max being 25 MGOe or more.

In addition, another corrosion-resistant film may further be laminated and formed on the surface of the chemical conversion film of the present invention. Such a configuration makes it possible to enhance/complement the characteristics of the chemical conversion film of the present invention or impart further functionalities. The chemical conversion film of the present invention has excellent adherence with a resin film, and, therefore, by forming a resin film on the surface of the chemical conversion film, the magnet can be provided with even higher corrosion resistance. When the magnet has a ring shape, in order to form a uniform film, it is preferable that the formation of a resin film on the surface of the chemical conversion film is performed by electrodeposition coating. A specific example of electrodeposition coating of a resin film is an epoxy resin based cationic electrodeposition coating.

EXAMPLES

Hereinafter, the present invention will be described in detail with reference to the examples, but the scope of the present invention is not limited to the following description.

Example 1

First Embodiment

A sintered magnet of a composition of 17 Nd-1 Pr-75 Fe-7 B (at %) and a size of length: 13 mm×width: 7 mm×thickness: 1 mm, which was obtained, as described in U.S. Pat. No. 4,770,723, for example, by pulverizing a known cast ingot and then finely grinding the same, followed by pressing, sintering, aging, and a surface working, was ultrasonically cleaned with water for 1 minute. Subsequently, the magnet was immersed in a treatment liquid (manufactured by NIHON PARKERIZING CO., LTD., trade name: PALLUCID 1000), which was prepared by dissolving 50 g of PALLUCID 1000MA and 17.5 g of AD-4990 in 1 L of ion exchange water and adjusting the pH thereof to 3.6 with an ammonium salt, at a bath temperature of 55° C. for 5 minutes to perform chemical conversion treatment. The magnet was removed from the treatment liquid, then washed with water, and subjected to a drying treatment at 160° C. for 35 minutes, thereby forming a chemical conversion film with a thickness of about 80 nm on the surface of the magnet.

The thus-obtained magnet having a chemical conversion film on the surface thereof was subjected to a depth profile analysis by Auger spectroscopy with respect to a part above the main phase and a part above the grain boundary phase (triple point) (PHI/680 manufactured by ULVAC-PHI, INCORPORATED was used as the apparatus. For the analysis, the magnet used was lapped with diamond on one side of the 13 mm×7 mm plane). FIG. 1 shows results of the analysis of a part above the main phase, and FIG. 2 shows results of the analysis of a part above the grain boundary phase (the sputtering time (minute) on the abscissa corresponds to the sputtering depth (nm), indicating that the interface between the chemical conversion film and the magnet is reached in a sputtering time of 80 minutes).

As is obvious from FIG. 1, above the main phase, a region at a depth of 20 nm from the outer surface of the chemical conversion film was characterized by having a high Zr content, showing that this region contains a large amount of Zr-containing compound (e.g., Zr oxide). The contents of constituent elements in this region were as follows: Zr: 15 at % to 25 at %, Nd: 18 at % to 23 at %, Fe: 3 at % to 18 at %, fluorine: about 1 at %, and oxygen: 33 at % to 65 at %. A region at a depth of 20 nm to 60 nm from the outer surface of the chemical conversion film was characterized by having a high Nd content, showing that this region contains a large amount of Nd-containing compound (e.g., Nd oxide). The contents of constituent elements in this region were as follows: Zr: 3 at % to 20 at %, Nd: 23 at % to 40 at %, Fe: 13 at % to 50 at %, fluorine: about 1 at %, and oxygen: 20 at % to 45 at %. As compared with the contents of constituent elements in a region thereabove, a region at a depth of 60 nm to 80 nm from the outer surface of the chemical conversion film (a 20 nm thick region immediately above the main phase) had a higher Fe content and lower Zr, Nd, and oxygen contents with little fluorine.

Figure 2:
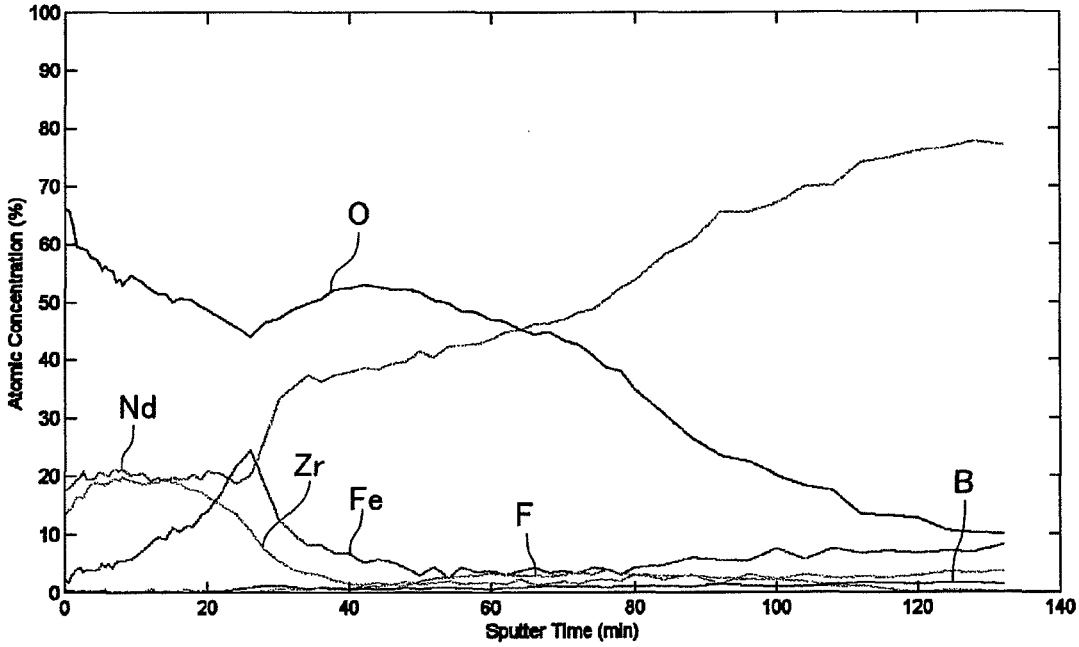
FIG. 2 Similarly, a chart showing results of a depth profile analysis of a chemical conversion film above the grain boundary phase.

As is obvious from FIG. 2, above the grain boundary phase, a region at a depth of 20 nm from the outer surface of the chemical conversion film was characterized by having a high Zr content, showing that this region contains a large amount of Zr-containing compound (e.g., Zr oxide). The contents of constituent elements in this region were as follows: Zr: 13 at % to 20 at %, Nd: 18 at % to 20 at %, Fe: 3 at % to 15 at %, and oxygen: 50 at % to 65 at %. Little fluorine was present. A region at a depth of 20 nm to 40 nm from the outer surface of the chemical conversion film was characterized by having a high Fe content, showing that this region contains a large amount of Fe-containing compound (e.g., Fe oxide). The contents of constituent elements in this region were as follows: Zr: 3 at % to 17 at %, Nd: 20 at % to 40 at %, Fe: 5 at % to 25 at %, fluorine: about 1 at %, and oxygen: 45 at % to 55 at %. A region at a depth of 40 nm to 80 nm from the outer surface of the chemical conversion film (a 40 nm thick region immediately above the grain boundary phase) was characterized by having high Nd and fluorine contents, showing that this region contains a large amount of compound containing these elements (e.g., Nd fluoride). The contents of constituent elements in this region were as follows: Zr: 1 at % to 3 at %, Nd: 40 at % to 55 at %, Fe: 3 at % to 5 at %, fluorine: 1 at % to 3 at %, and oxygen: 35 at % to 55 at %.

Example 2

First Embodiment

Using a radially anisotropic ring sintered magnet of the same composition as the sintered magnet used in Example 1 with a size of outer diameter: 30 mm×inner diameter: 25 mm×length: 28.5 mm, a chemical conversion film having a thickness of about 80 nm was formed on the surface of the magnet in the same manner as in Example 1. The thus-obtained magnet having a chemical conversion film on the surface thereof was subjected to a pressure cooker test for 24 hours under the following conditions: temperature: 125° C., relative humidity: 85%, and pressure: 2 atm. Subsequently, shed particles were removed using a tape, and the magnet was weighed before and after the test to determine the shed amount. The shed amount was 7.0 g/m$^2$.

Comparative Example 1

The same magnet as the radially anisotropic ring sintered magnet used in Example 2 was ultrasonically cleaned with water for 1 minute. Subsequently, the magnet was immersed in a treatment liquid, which was prepared by dissolving 7.5 g of phosphoric acid in 1 L of ion exchange water and adjusting the pH thereof to 2.9 with sodium hydroxide, at a bath temperature of 60° C. for 5 minutes to perform chemical conversion treatment. The magnet was removed from the treatment liquid, then washed with water, and subjected to a drying treatment at 160° C. for 35 minutes, thereby forming a chemical conversion film with a thickness of about 80 nm on the surface of the magnet. The thus-obtained magnet having a chemical conversion film on the surface thereof was subjected to a pressure cooker test in the same manner as in Example 2, and the shed amount was determined. The shed amount was 11.0 g/m$^2$, which was larger than the shed amount in Example 2.

Comparative Example 2

The same magnet as the radially anisotropic ring sintered magnet used in Example 2 was ultrasonically cleaned with water for 1 minute. Subsequently, the magnet was immersed in a treatment liquid, which was prepared by dissolving 7 g of chromic acid in 1 L of ion exchange water, at a bath temperature of 60° C. for 10 minutes to perform chemical conversion treatment. The magnet was removed from the treatment liquid, then washed with water, and subjected to a drying treatment at 160° C. for 35 minutes, thereby forming a chemical conversion film with a thickness of about 80 nm on the surface of the magnet. The thus-obtained magnet having a chemical conversion film on the surface thereof was subjected to a pressure cooker test in the same manner as in Example 2, and the shed amount was determined. The shed amount was 11.5 g/m$^2$, which was larger than the shed amount in Example 2.

Example 3

First Embodiment

POWERNICS (product name, manufactured by NIPPON PAINT CO., LTD.) was electrodeposited on the magnet obtained in Example 2 having a chemical conversion film on the surface thereof (epoxy resin based cationic electrodeposition coating, conditions: 200 V and 150 seconds), followed by baking and drying at 195° C. for 60 minutes, thereby forming an epoxy resin film having a thickness of 20 μm on the surface of the chemical conversion film. The thus-obtained magnet having a chemical conversion film and a resin film on the surface thereof was subjected to a pressure cooker test under the following conditions: temperature: 120° C., relative humidity: 100%, and pressure: 2 atm. As a result, no abnormalities were observed in the appearance.

Comparative Example 3

Using the magnet obtained in Comparative Example 1 having a chemical conversion film on the surface thereof, a resin film having a thickness of 20 μm was formed on the surface of the chemical conversion film in the same manner as in Example 3, and a pressure cooker test was performed in the same manner as in Example 3. As a result, blisters were observed on the surface of the resin film.

Example 4

Second Embodiment

A sintered magnet of a composition of 17 Nd-1 Pr-75 Fe-7 B (at %) with a size of length: 13 mm×width: 7 mm×thickness: 1 mm, which was obtained, as described in U.S. Pat. No. 4,770,723, for example, by pulverizing a known cast ingot and then finely grinding the same, followed by pressing, sintering, aging, and a surface working, was subjected to a heat treatment in vacuum (2 Pa) at 570° C. for 3 hours→at 460° C. for 6 hours. Next, the heat-treated magnet was ultrasonically cleaned with water for 1 minute. Subsequently, the magnet was immersed in a treatment liquid (manufactured by NIHON PARKERIZING CO., LTD., trade name: PALLUCID 1000), which was prepared by dissolving 50 g of PALLUCID 1000MA and 17.5 g of AD-4990 in 1 L of ion exchange water and adjusting the pH thereof to 3.6 with an ammonium salt, at a bath temperature of 55° C. for 5 minutes to perform chemical conversion treatment. The magnet was removed from the treatment liquid, then washed with water, and subjected to a drying treatment at 160° C. for 35 minutes, thereby forming a chemical conversion film with a thickness of about 30 nm on the surface of the magnet.

Figure 3:
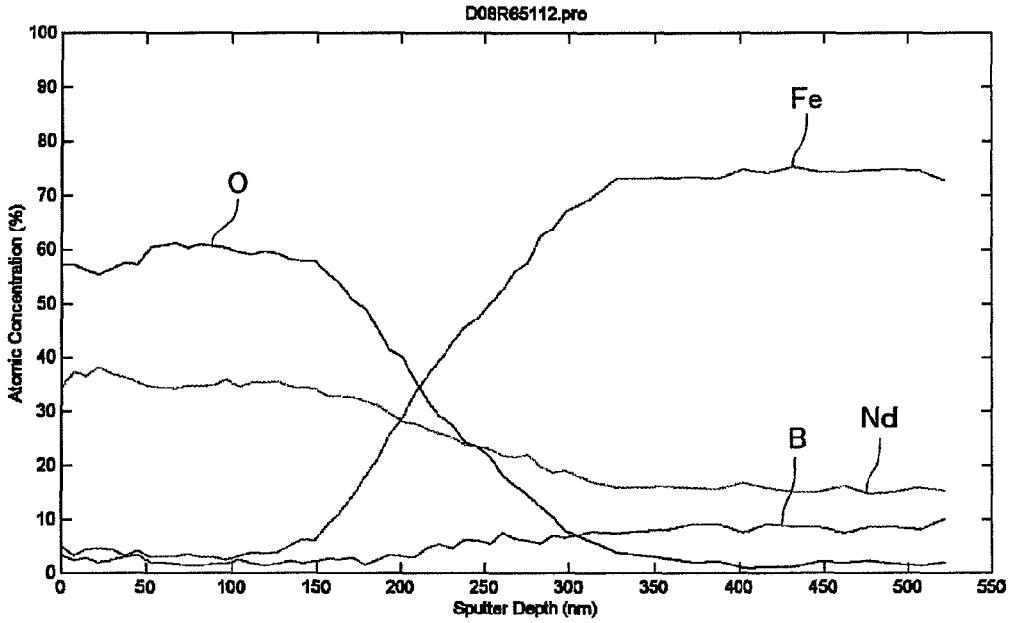
FIG. 3 A chart showing results of an Auger spectroscopy depth profile analysis of a layer formed in the magnet surface by a heat treatment in Example 4.

The surface of the magnet before the heat treatment and the surface of the magnet after the heat treatment were observed using a scanning electron microscope (SEM). The observation showed that as a result of the heat treatment of the magnet, the difference between the main phase and the grain boundary phase of the magnet surface was no longer recognized, and the magnet surface was covered with a uniform compound layer and thus made uniform. FIG. 3 shows results of an Auger spectroscopy depth profile analysis of the magnet after the heat treatment (PHI/680 manufactured by ULVAC-PHI, INCORPORATED was used as the apparatus. For the analysis, the magnet used was lapped with diamond on one side of the 13 mm×7 mm plane). As is obvious from FIG. 3, the layer formed in the magnet surface was at least 150 nm thick and had a high Nd content of 35 at % to 38 at % and a high oxygen content of 55 at % to 60 at %, showing that the layer was made of a compound containing these elements (e.g., Nd oxide).

Figure 4:
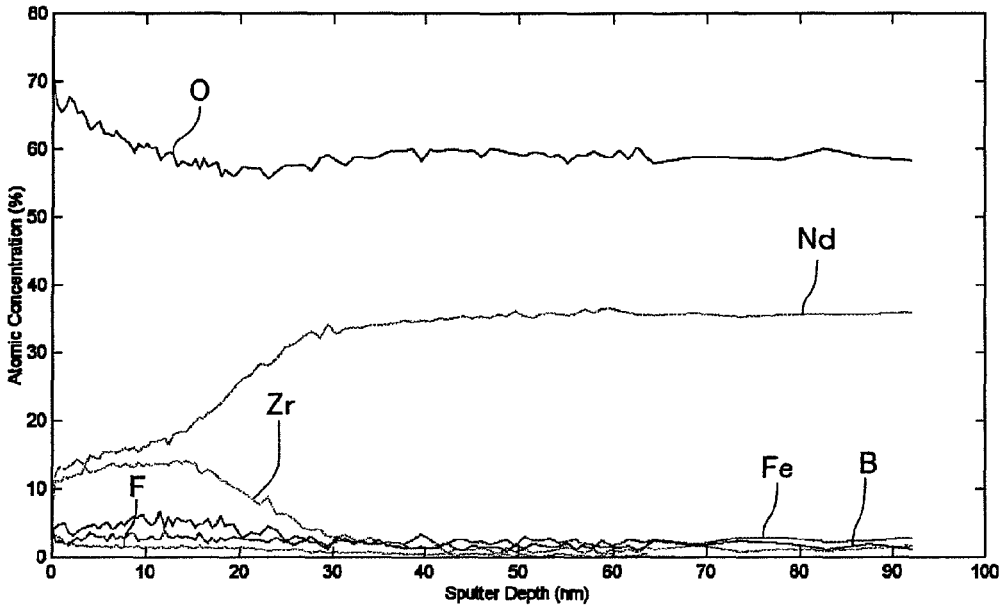
FIG. 4 Similarly, a chart showing results of a depth profile analysis of a chemical conversion film.

FIG. 4 shows results of an Auger spectroscopy depth profile analysis of the magnet having a chemical conversion film on the surface thereof. As is obvious from FIG. 4, the chemical conversion film was characterized in that a comparison between a region of the outer-surface-side half of its thickness and a region of the magnet-side half of its thickness showed that the former had a higher Zr content than the latter. This indicated that the former region contained a large amount of Zr-containing compound (e.g., Zr oxide). In addition, the chemical conversion film had a high Nd content, showing that a large amount of Nd-containing compound (e.g., Nd oxide or Nd fluoride) was contained therein. The contents of constituent elements in the chemical conversion film were as follows: Zr: 3 at % to 15 at %, Nd: 8 at % to 35 at %, fluorine: about 3 at %, and oxygen: 55 at % to 70 at %.

Example 5

Second Embodiment

A chemical conversion film having a thickness of about 30 nm was formed on the surface of the magnet in the same manner as in Example 4, except that aging was not performed prior to the surface working, and that the heat treatment after the surface working was performed to also achieve the purpose of aging. The same results as in Example 4 were obtained.

Example 6

Second Embodiment

Using a radially anisotropic ring sintered magnet of the same composition as the sintered magnet used in Example 4 with a size of outer diameter: 40 mm×inner diameter: 33 mm×length: 9 mm, a chemical conversion film having a thickness of about 30 nm was formed on the surface of the magnet in the same manner as in Example 5. The thus-obtained magnet having a chemical conversion film on the surface thereof was subjected to a pressure cooker test for 48 hours under the following conditions: temperature: 120° C., relative humidity: 100%, and pressure: 2 atm. Subsequently, shed particles were removed using a tape, and the magnet was weighed before and after the test to determine the shed amount. The shed amount was 0.5 g/m$^2$, which was significantly small.

Comparative Example 4

The same magnet as the radially anisotropic ring sintered magnet used in Example 6 was subjected to a heat treatment in the same manner as in Example 4, and then ultrasonically cleaned with water for 1 minute. Subsequently, the magnet was immersed in a treatment liquid, which was prepared by dissolving 7.5 g of phosphoric acid in 1 L of ion exchange water and adjusting the pH thereof to 2.9 with sodium hydroxide, at a bath temperature of 60° C. for 5 minutes to perform chemical conversion treatment. The magnet was removed from the treatment liquid, then washed with water, and subjected to a drying treatment at 160° C. for 35 minutes, thereby forming a chemical conversion film with a thickness of about 30 nm on the surface of the magnet. The thus-obtained magnet having a chemical conversion film on the surface thereof was subjected to a pressure cooker test in the same manner as in Example 6, and the shed amount was determined. The shed amount was 6.5 g/m$^2$, which was larger than the shed amount in Example 6.

Comparative Example 5

The same magnet as the radially anisotropic ring sintered magnet used in Example 6 was subjected to a heat treatment in the same manner as in Example 4, and then ultrasonically cleaned with water for 1 minute. Subsequently, the magnet was immersed in a treatment liquid, which was prepared by dissolving 7 g of chromic acid in 1 L of ion exchange water, at a bath temperature of 60° C. for 10 minutes to perform chemical conversion treatment. The magnet was removed from the treatment liquid, then washed with water, and subjected to a drying treatment at 160° C. for 35 minutes, thereby forming a chemical conversion film with a thickness of about 30 nm on the surface of the magnet. The thus-obtained magnet having a chemical conversion film on the surface thereof was subjected to a pressure cooker test in the same manner as in Example 6, and the shed amount was determined. The shed amount was 9.0 g/m$^2$, which was larger than the shed amount in Example 6.

Example 7

Second Embodiment

Using a polar anisotropic ring sintered magnet of the same composition as the sintered magnet used in Example 4 with a size of outer diameter: 10 mm×inner diameter: 5.5 mm×length: 16 mm, a chemical conversion film having a thickness of about 30 nm was formed on the surface of the magnet in the same manner as in Example 4. The thus-obtained magnet having a chemical conversion film on the surface thereof was subjected to a pressure cooker test in the same manner as in Example 6, and the shed amount was determined. The shed amount was as small as 1.4 g/m$^2$.

Example 8

Second Embodiment

POWERNICS (product name: manufactured by NIPPON PAINT CO., LTD.) was electrodeposited on the magnet obtained in Example 6 having a chemical conversion film on the surface thereof (epoxy resin based cationic electrodeposition coating, conditions: 200 V and 150 seconds), followed by baking and drying at 195° C. for 60 minutes, thereby forming an epoxy resin film having a thickness of 20 μm on the surface of the chemical conversion film. The thus-obtained magnet having a chemical conversion film and a resin film on the surface thereof was subjected to a pressure cooker test in the same manner as in Example 6. As a result, no abnormalities were observed in the appearance.

Comparative Example 6

Using the magnet obtained in Comparative Example 4 having a chemical conversion film on the surface thereof, a resin film having a thickness of 20 μm was formed on the surface of the chemical conversion film in the same manner as in Example 8, and a pressure cooker test was performed in the same manner as in Example 6. As a result, blisters were observed on the surface of the resin film.

Example 9

Second Embodiment

A radially anisotropic ring sintered magnet of a composition of 11 Nd-1 Dy-3 Pr-78 Fe-1 Co-6 B (at %) with a size of outer diameter: 35 mm×inner diameter: 29.5 mm×length: 50 mm, which was obtained, as described in U.S. Pat. No. 4,770,723, for example, by pulverizing a known cast ingot and then finely grinding the same, followed by pressing, sintering, aging, and a surface working, was arranged and housed in a box made of molybdenum with a size of length: 30 cm×width: 20 cm×height: 10 cm (including a case body with an open top and a lid, and configured to allow outside air to pass between the case body and the lid), and then subjected to a heat treatment in the same manner as in Example 4. The surface of the magnet after the heat treatment showed no fluctuations in the appearance and had a uniform, dark finish. SEM observation of the surface of the magnet showed that the surface was covered with a uniform layer and thus made uniform. The oxygen content in the layer formed in the magnet surface in the same manner as in Example 4 was measured. As a result, the content was about 27 at %. Subsequently, a chemical conversion film having a thickness of about 30 nm was formed on the surface of the magnet in the same manner as in Example 4. The thus-obtained magnet having a chemical conversion film on the surface thereof was immersed in ethanol and then ultrasonically cleaned for 3 minutes. Subsequently, a silicone based adhesive (SE1750: manufactured by DOW CORNING TORAY CO., LTD.) was applied to the entire inner peripheral surface thereof. Also, the same silicone based adhesive was applied to the entire outer peripheral surface of a rotor core (diameter: 29.4 mm×length: 50 mm, material: SS400) obtained by immersing an iron core in acetone, and then ultrasonically cleaning the same for 3 minutes. The rotor core was inserted into the inner diameter portion of the magnet, then subjected to a heat treatment in air at 150° C. for 1.5 hours, and allowed to stand at room temperature for 60 hours, thereby giving an adhesion body made of the magnet and the rotor core with a 50 μm thick adhesive layer. The adhesion body was allowed to stand in a high-temperature, high-humidity environment with a temperature of 85° C. and a relative humidity of 85% RH, and the shear strength after standing for 250 hours and the shear strength after standing for 500 hours were compared with the shear strength of the adhesion body before standing in the high-temperature, high-humidity environment (the shear test was performed using UTM-1-5000C manufactured by TOYO BALDWIN CO., LTD.). As a result, while the shear strength before standing in the high-temperature, high-humidity environment was 4.8 MPa, the shear strength after standing for 250 hours and the shear strength after standing for 500 hours were both 4.05 MPa. It was thus shown that although there was a decrease from the shear strength before standing in the high-temperature, high-humidity environment, the shear strength of the adhesion body was still high. In addition, separations between the magnet and the rotor core were all due to the cohesive failure of the adhesive.

INDUSTRIAL APPLICABILITY

According to the present invention, an R—Fe—B based sintered magnet having on a surface thereof a chemical conversion film with higher corrosion resistance than a conventional chemical conversion film such as a phosphate film can be provided, as well as a method for producing the same. In this respect, the present invention is industrially applicable.

The invention claimed is:

1. A corrosion-resistant magnet, comprising a chemical conversion film containing at least Zr, Nd, fluorine, and oxygen as constituent elements directly on a surface of an R—Fe—B based sintered magnet, wherein R is a rare-earth element including at least Nd, and wherein the chemical conversion film does not contain phosphorus.

2. A corrosion-resistant magnet according to claim 1, wherein the chemical conversion film further contains Fe as a constituent element.

3. A corrosion-resistant magnet according to claim 2, wherein the chemical conversion film has a thickness of between 10 nm and 150 nm.

4. A corrosion-resistant magnet according to claim 2, wherein a comparison between a first region of an outer-surface-side half of the thickness of the chemical conversion film and a second region of a magnet-side half of the thickness of the chemical conversion film shows that the first region has a higher Zr content than the second region.

5. A corrosion-resistant magnet according to claim 4, wherein the first region of the outer-surface-side half has a maximum Zr content of between 5 at % and 30 at % in the thickness direction thereof.

6. A corrosion-resistant magnet according to claim 2, wherein the chemical conversion film has higher Nd and fluorine contents above a grain boundary phase of the surface of the magnet than above a main phase of the surface of the magnet.

7. A corrosion-resistant magnet according to claim 6, wherein the chemical conversion film has a maximum fluorine content of between 1 at % and 5 at % in the thickness direction thereof above the grain boundary phase of the surface of the magnet.

8. A corrosion-resistant magnet according to claim 2, further comprising a resin film on a surface of the chemical conversion film.

9. A corrosion-resistant magnet according to claim 1, wherein the surface of the magnet has a layer made of a compound containing Nd and oxygen.

10. A corrosion-resistant magnet according to claim 9, wherein the chemical conversion film has a thickness of between 10 nm and 150 nm.

11. A corrosion-resistant magnet according to claim 9, wherein the chemical conversion film has a maximum Zr content of between 10 at % and 20 at % in the thickness direction thereof.

12. A corrosion-resistant magnet according to claim 9, further comprising a resin film on a surface of the chemical conversion film.

* * * * *

UNITED STATES PATENT AND TRADEMARK OFFICE

CERTIFICATE OF CORRECTION

PATENT NO. : 8,641,833 B2
APPLICATION NO. : 13/002571
DATED : February 4, 2014
INVENTOR(S) : Ninae et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 496 days.

Signed and Sealed this
Twenty-sixth Day of August, 2014

Michelle K. Lee

Michelle K. Lee
*Deputy Director of the United States Patent and Trademark Office*